United States Patent [19]

Ookawa

[11] Patent Number: 5,019,779

[45] Date of Patent: May 28, 1991

[54] IGNITION APPARATUS FOR AN INTERNAL COMBUSTION ENGINE

[75] Inventor: Kiyoshi Ookawa, Himeji, Japan

[73] Assignee: Mitsubishi Denki Kabushiki Kaisha, Tokyo, Japan

[21] Appl. No.: 498,652

[22] Filed: Mar. 26, 1990

[30] Foreign Application Priority Data

Mar. 27, 1989 [JP] Japan ..... 1-33223
Mar. 28, 1989 [JP] Japan ..... 1-34360

[51] Int. Cl.[5] ..... F02P 17/00
[52] U.S. Cl. ..... 324/388; 361/253
[58] Field of Search ..... 324/388, 391, 392; 361/253

[56] References Cited

U.S. PATENT DOCUMENTS 4,035,619 7/1977 Cholet ..... 324/388
4,280,166 7/1981 Jesse et al. ..... 361/253
4,327,310 4/1982 Jörg ..... 361/253
4,401,948 8/1983 Miura et al. ..... 324/388
4,918,389 4/1990 Schleupen et al. ..... 324/399
4,933,799 6/1990 Lai ..... 361/29

FOREIGN PATENT DOCUMENTS 20069 12/1980 European Pat. Off. ..... 324/388
19176 1/1989 Japan .

*Primary Examiner*—Kenneth Wieder
*Assistant Examiner*—Maura K. Regan
*Attorney, Agent, or Firm*—Sughrue, Mion, Zinn, Macpeak and Seas

[57] ABSTRACT

An ignition apparatus for an internal combustion engine has first and second comparators which compare the voltage of a winding of an ignition coil with reference voltages at first and second lengths of time after an ignition signal. The output of the first comparator indicates if the secondary winding of the ignition coil is connected to an open circuit. The output of the second comparator indicates if the secondary winding is shorted to ground. The comparators are connected to an OR gate, and the output of the OR gate is used to indicate misfiring.

12 Claims, 2 Drawing Sheets

IGNITION APPARATUS FOR AN INTERNAL COMBUSTION ENGINE

BACKGROUND OF THE INVENTION

This invention relates to an ignition apparatus for an internal combustion engine. More particularly, it relates to an ignition apparatus which can detect misfiring of an engine due to a fault in the ignition system of the engine.

When a problem occurs in the ignition system of an internal combustion engine, so-called "misfiring" can take place in which a cylinder of the engine fails to ignite. When misfiring occurs, uncombusted fuel is exhausted from the engine. The uncombusted fuel then flows into the catalytic converter for the engine, where it undergoes a highly exothermic chemical reaction with the catalyst of the converter. The intense heat of the reaction can damage the converter, and because the converter is raised to a high temperature by the reaction, a fire can result if the converter comes into contact with a flammable material.

Therefore, it is important to detect misfiring in an engine and to stop the supply of fuel to a misfiring cylinder. Misfiring can have various causes, one of which is a failure of the ignition system to properly control the current flowing through the ignition coil for the engine. Some engines are equipped with misfiring sensors which monitor the operation of power transistors for controlling the current of the primary winding of the ignition coil for the engine. Such misfiring sensors are capable of sensing misfiring due to a malfunction of the power transistors or of parts which control the operation of the power transistors.

However, misfiring can also be caused by a problem between the power transistors and the spark plug, such as an open circuit or a short to ground in the cables which connect the spark plugs to the distributor. A conventional misfiring sensor can not detect misfiring due to such problems, since these problems do not necessarily affect the operation of the power transistors.

SUMMARY OF THE INVENTION

Accordingly, it is an object of the present invention to provide an ignition apparatus for an internal combustion engine which can reliably detect misfiring due to an open circuit or a short to ground between the ignition coil and the spark plugs of the engine.

An ignition apparatus according to the present invention has an ignition coil having primary and secondary windings. The primary winding current is controlled by a switching circuit connected in series with the primary winding. The opening and closing of the switching circuit is controlled by an ignition signal generator which generates an ignition signal. When a first timer determines that a first length of time has elapsed since the ignition signal, a comparator compares the winding voltage of one of the windings of the ignition coil with a first reference voltage. The first reference voltage is selected to be larger than the winding voltage when the first length of time elapses if the engine is operating normally and to be less than the winding voltage if a cylinder of the engine is misfiring. The output of the comparator indicates the occurrence of misfiring in a cylinder of the engine.

The first reference voltage can be selected to be less than the winding voltage when the first length of time elapses if the secondary winding of the ignition coil is connected to an open circuit, or it can be selected to be less than the winding voltage when the first length of time elapses if the secondary winding of the ignition coil is shorted to ground.

The present invention may include a second comparator which compares the winding voltage with a second reference voltage when a second length of time has elapsed since the ignition signal. The second reference voltage is selected to be larger than the winding voltage when the second length of time elapses if the engine is operating normally and to be less than the winding voltage if a cylinder is misfiring. In a preferred embodiment, the second length of time is greater than the first length of time, and the second reference voltage is smaller than the first reference voltage. The winding voltage exceeds the first reference voltage if the secondary winding of the ignition coil is connected to an open circuit when the first length of time elapses, and the winding voltage exceeds the second reference voltage if the secondary winding of the ignition coil is shorted to ground when the second length of time elapses.

The winding voltage is the voltage at a point on one of the windings of the ignition coil. In one preferred embodiment, the winding voltage is the voltage at the junction of the primary winding and the switching circuit. In another preferred embodiment, the winding voltage is the voltage across a resistor which is connected between the secondary winding and ground.

DESCRIPTION OF THE PREFERRED EMBODIMENTS

Figure 1:
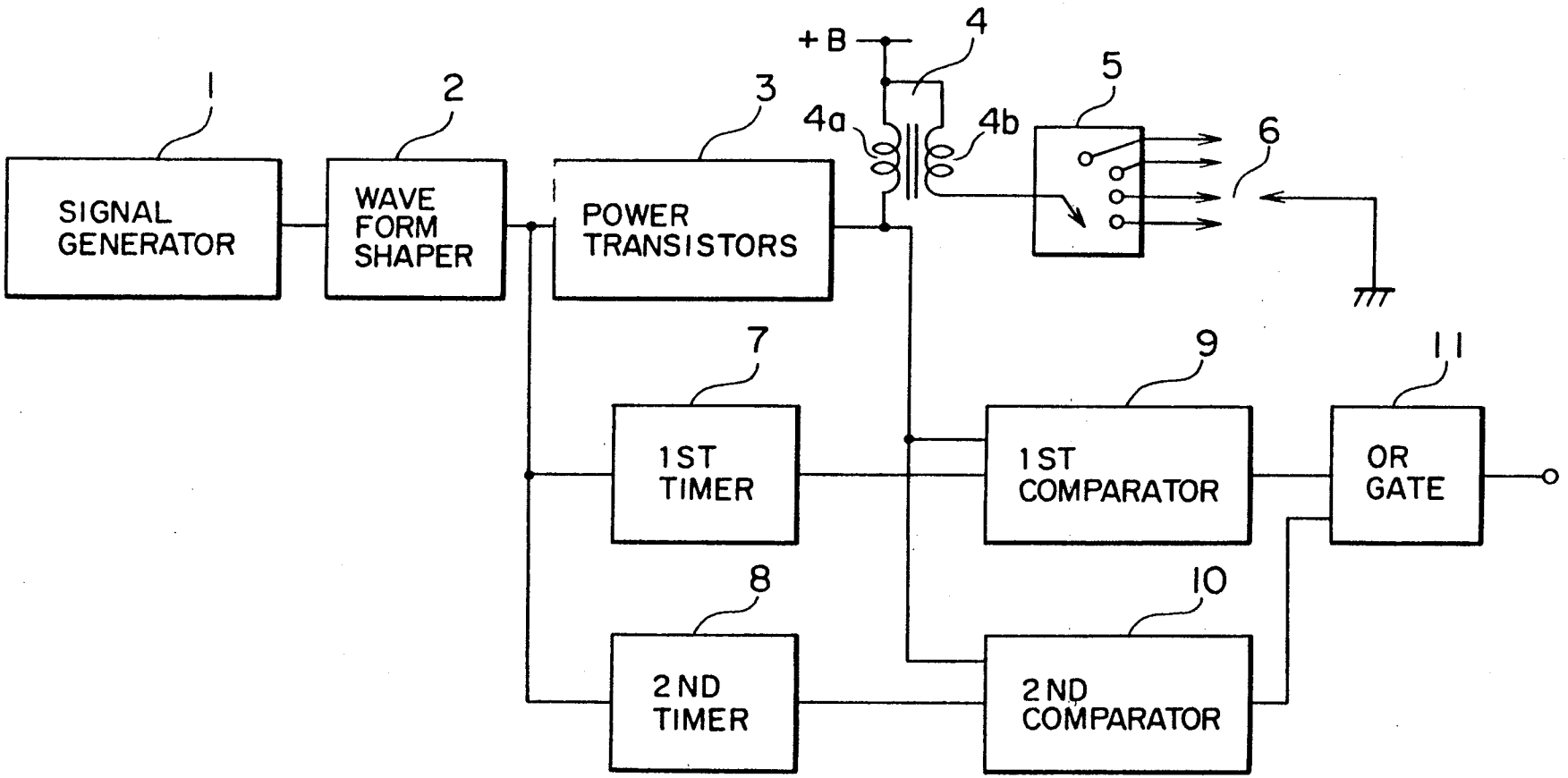
FIG. 1 is a block diagram of a first embodiment of an ignition apparatus according to the present invention.

FIG. 1 schematically illustrates a first embodiment of the present invention as applied to an unillustrated internal combustion engine. In this embodiment, the engine has four cylinders, but the present invention is not limited to use with an engine having any particular number of cylinders. A signal generator 1 generates an alternating current signal in synchrony with the rotation of the engine. There are no restrictions on the type of signal generator 1 which is employed. Signal generators 1 for use in ignition systems are well known to those skilled in the art, and any conventional type may be used. The output of the signal generator 1 is input to a waveform shaper 2, which generates a square wave which changes between a first level and a second level at a prescribed voltage of the output of the signal generator 1. A change in the level of the square wave, such as a falling edge, is employed as an ignition signal for controlling the ignition of the engine. Therefore, the signal generator 1 and the waveform shaper 2 together constitute means for generating an ignition signal. The output of the waveform shaper 2 is input to a switching circuit in the form of a power transistor circuit 3. The power transistor circuit 3 is connected in series with the primary winding 4*a* of an ignition coil 4. The positive terminal of the ignition coil 4 is connected to a direct current power supply such as a storage battery for the engine. The power transistor circuit 3 controls the flow of current through the primary winding 4*a* in accordance with the output signal from the waveform shaper 2. For example, the power transistor circuit 3 can be constructed so as to cut off the current through the primary winding 4a each time there is a falling edge of the output of the waveform shaper 2. The secondary winding 4b of the ignition coil 4 is connected to a distributor 5, which is connected to the spark plugs 6 of the engine, only one of which is illustrated.

A first timer 7 and a second timer 8 are connected to the waveform shaper 2 and are triggered by the ignition signal from the waveform shaper 2. When the first timer 7 is triggered, it outputs a first reference voltage when a first length of time has elapsed. Similarly, when the second timer 8 is triggered, it outputs a second reference voltage when a second length of time has elapsed. The second length of time is longer than the first length of time, and the second reference voltage is lower than the first reference voltage.

The voltage at a point between the primary winding 4a of the ignition coil 4 and the power transistor circuit 3 is input to one of the input terminals of a first non-inverting type comparator 9 and a second non-inverting type comparator 10. This voltage will be referred to as the primary winding voltage. The output voltages of the first and second timers 7 and 8 are applied to the other input terminals of the first and second comparators 9 and 10. Each comparator 9 and 10 generates a high output signal when the primary winding voltage is higher than the reference voltage from the corresponding timer 7 and 8, respectively, and it generates a low output signal at other times. The output signals from the comparators 9 and 10 are applied to an OR gate 11, which generates a high output signal when either of the comparators generates a high output signal.

The first reference voltage and the first length of time are chosen so that if there is an open circuit between the secondary winding 4b of the ignition coil 4 and the spark plug 6 which is then connected to the ignition coil 4 through the distributor 5, when the first length of time elapses, the primary winding voltage will exceed the first reference voltage, so the first comparator 9 will generate a high output signal. On the other hand, if there is not an open circuit between the secondary winding 4b and the spark plug 6, the primary winding voltage will be lower than the first reference voltage when the first length of time elapses, and the first comparator 9 will generate a low output signal.

Similarly, the second reference voltage and the second length of time are chosen so that if there is a ground short between the secondary winding 4b of the ignition coil 4 and the spark plug 6 which is supposed to generate a spark, when the second length of time elapses, the primary winding voltage will exceed the second reference voltage, so the second comparator 10 will generate a high output signal. On the other hand, if there is not a ground short between the secondary winding 4b and the spark plug 6, the primary winding voltage will be lower than the second reference voltage when the second length of time elapses and the second comparator 10 will generate a low output signal.

Thus, whenever there is an open circuit or a ground short in the ignition system between the ignition coil 4 and the spark plug 6 which is supposed to generate a spark, one of the comparators 9 and 10 will generate a high output signal, and the OR gate 11 will generate a high output signal. A high output signal from the OR gate 11 therefore indicates misfiring. The output signal from the OR gate 11 can be input to a fuel controller for the engine, and the supply of fuel to the misfiring cylinder can be cut off. Fuel controllers which are capable of cutting off the fuel supply in response to a misfiring signal are well known to those skilled in the art, so an explanation thereof will be omitted.

Figure 2:
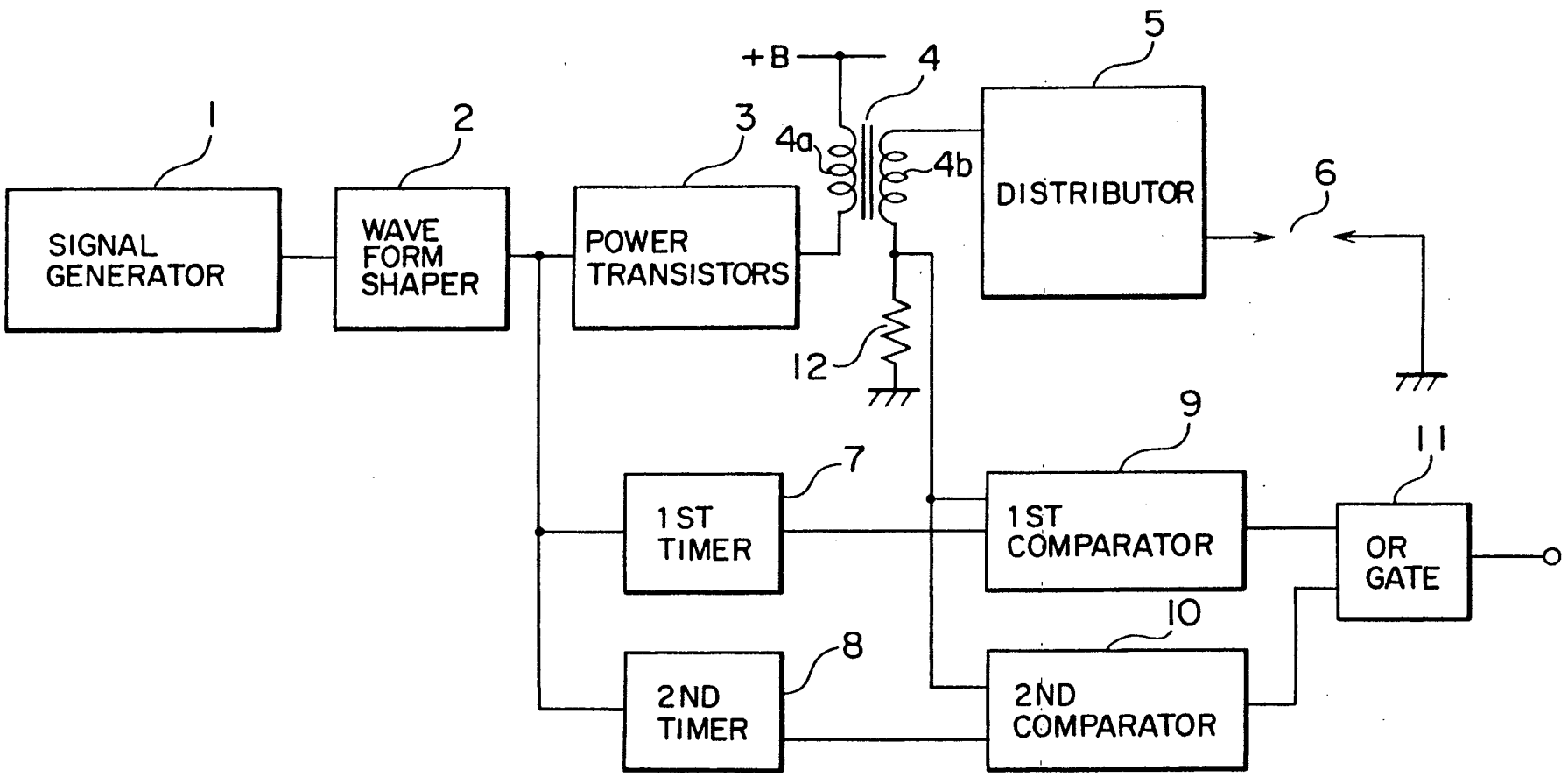
FIG. 2 is a block diagram of a second embodiment of the present invention.

FIG. 2 illustrates a second embodiment of the present invention. In this embodiment, a resistor 12 is connected between the secondary winding 4b of the ignition coil 4 and ground, and the voltage at the junction of the resistor 12 and the secondary winding 4b of the ignition coil 4, which will be referred to as the secondary winding voltage, is input to first and second comparators 9 and 10. The resistor 12 generally has a resistance on the order of 100 ohms, although the exact value is not critical. The structure of this embodiment is otherwise identical to that of the first embodiment. The first and second comparators 9 and 10 compare the secondary winding voltage with first and second reference voltages which are generated by first and second timers 7 and 8, respectively, when first and second lengths of times have elapsed after an ignition signal from the waveform shaper 2. The first reference voltage and the first length of time are chosen so that if there is an open circuit between the secondary winding 4b of the ignition coil 4 and the spark plug 6 which is to generate a spark, when the first length of time elapses, the secondary winding voltage will exceed the first reference voltage, so the first comparator 9 will generate a high output signal. Similarly, the second reference voltage and the second length of time are chosen so that if there is a ground short between the secondary winding 4b of the ignition coil 4 and the spark plug 6, when the second length of time elapses, the secondary winding voltage will exceed the second reference voltage, so the second comparator 10 will generate a high output signal. As in the previous embodiment, the OR gate 11 generates a high output signal when either of the comparators generates a high output signal, i.e., whenever there is an open circuit or a ground short between the ignition coil 4 and the spark plug 6 which is to generate a spark.

It can be seen that an ignition apparatus according to the present invention can detect misfiring of any cylinder of an engine even when the power transistors are functioning properly. Therefore, the supply of fuel to a misfiring cylinder can be quickly stopped and damage to a catalytic converter for the engine can be prevented.

In the above-described embodiments, the reference voltages are generated by the first and second timers 7 and 8. However, it is possible to employ separate means for generating the reference voltages and to provide circuits which input the reference voltages to the comparators when the first or second lengths of time have elapsed.

Although the illustrated embodiment employ both a first and second comparator, it is possible to omit one of the comparators and the corresponding timer. For example, it is possible to omit the second timer 8 and the second comparator 10 and to detect misfiring only when there is an open circuit using the first comparator 9. Alternatively, it is possible to omit the second timer 8 and the second comparator 10 and to set the first length of time and the first reference voltage so that the first comparator 9 detects misfiring due to ground shorts instead of due to open circuits.

What is claimed is:

1. An ignition apparatus for an internal combustion engine comprising:

an ignition signal generator which generates an ignition signal in synchrony with the rotation of an engine;

an ignition coil having a primary winding and a secondary winding;

a switching circuit connected to the ignition signal generator and the primary winding of the ignition coil for controlling the flow of current through the primary winding in accordance with the ignition signal;

a first timer for measuring a first length of time from the ignition signal; and a first comparator responsive to the first timer for comparing the winding voltage of one of the windings of the ignition coil with a first reference voltage when the first length of time elapses and generating a corresponding output signal, wherein the first reference voltage is chosen to be smaller than the winding voltage when the first length of time elapses if the secondary winding of the ignition coil is connected to an open circuit.

2. An ignition apparatus as claimed in claim 1, wherein the winding voltage is the voltage at the connection of the primary winding to the switching circuit.

3. An ignition apparatus as claimed in claim 1, wherein the ignition signal generator comprises:

a signal generator which generates an alternating current output signal in synchrony with the rotation of the engine; and a waveform shaper for generating an output signal which changes between a first level and a second level when the output of the signal generator has a prescribed voltage.

4. An ignition apparatus for an internal combustion engine comprising:

an ignition signal generator which generates an ignition signal in synchrony with the rotation of an engine;

an ignition coil having a primary winding and a secondary winding;

a switching circuit connected to the ignition signal generator and the primary winding of the ignition coil for controlling the flow of current through the primary winding in accordance with the ignition signal;

a first timer for measuring a first length of time from the ignition signal; and a first comparator responsive to the first timer for comparing the winding voltage of one of the windings of the ignition coil with a first reference voltage when the first length of time elapses and generating a corresponding output signal, further comprising:

a second timer for measuring a second length of time from the ignition signal, the second length of time being longer than the first length of time; and a second comparator responsive to the second timer for comparing the winding voltage of one of the windings of the ignition coil with a second reference voltage when the second length of time elapses and generating a corresponding output signal, the second reference voltage being smaller than the first reference voltage.

5. An ignition apparatus as claimed in claim 4, wherein:

the first reference voltage is chosen to be smaller than the winding voltage when the first length of time elapses if the secondary winding of the ignition coil is connected to an open circuit; and the second reference voltage is chosen to be smaller than the winding voltage when the second length of time elapses if the secondary winding of the ignition coil is shorted to ground.

6. An ignition apparatus as claimed in claim 4, further comprising an OR gate which receives the output signals of the first and second comparators and generates an output signal which is the logical sum of the output signals of the comparators.

7. An ignition apparatus for an internal combustion engine comprising:

an ignition signal generator which generates an ignition signal in synchrony with the rotation of an engine;

an ignition coil having a primary winding and a secondary winding;

a switching circuit connected to the ignition signal generator and the primary winding of the ignition coil for controlling the flow of current through the primary winding in accordance with the ignition signal;

a first timer for measuring a first length of time from the ignition signal; and a first comparator responsive to the first timer for comparing the winding voltage of one of the windings of the ignition coil with a first reference voltage when the first length of time elapses and generating a corresponding output signal, wherein the first reference voltage is chosen to be smaller than the winding voltage when the first length of time elapses if the secondary winding of the ignition coil is shorted to ground.

8. An ignition apparatus as claimed in claim 7, wherein the winding voltage is the voltage at the connection of the primary winding to the switching circuit.

9. An ignition apparatus as claimed in claim 7, further comprising a resistor connected to the secondary winding, wherein the winding voltage is the voltage across the resistor.

10. An ignition apparatus for an internal combustion engine comprising:

a signal generator which generates an alternating current output signal in synchrony with the rotation of the engine;

a waveform shaper for generating an output signal which changes between a first level and a second level when the output of the signal generator has a prescribed voltage;

an ignition coil having a primary winding and a secondary winding;

a switching circuit connected in series with the primary winding of the ignition coil and connected to the waveform shaper, the switching circuit being gated by a change in the level of the output signal of the waveform shaper;

a first timer connected to the waveform shaper for measuring a first length of time from a change in the output level of the waveform shaper;

means for generating a first reference voltage;

a first comparator responsive to the first timer for comparing the primary winding voltage at the junction of the primary winding and the switching circuit with the first reference voltage when the first length of time elapses and generating a corresponding output signal, the first reference voltage being less than the primary winding voltage when the first length of time elapses if the secondary winding is connected to an open circuit;

a second timer connected to the waveform for measuring a second length of time from a change in the output level of the waveform shaper, the second length of time being longer than the first length of time;

means for generating a second reference voltage which is smaller than the first reference voltage; and a second comparator responsive to the second timer for comparing the primary winding voltage with the second reference voltage when the second length of time elapses and generating a corresponding output signal, the second reference voltage being less than the primary winding voltage when the second length of time elapses if the secondary winding is shorted to ground.

11. An ignition apparatus for an internal combustion engine comprising:

a signal generator for generating an alternating current output signal in synchrony with the rotation of the engine;

a waveform shaper for generating an output signal which changes between a first level and a second level when the output of the signal generator has a prescribed voltage;

an ignition coil having a primary winding and a secondary winding;

a resistor connected between the secondary winding and ground;

a switching circuit connected in series with the primary winding of the ignition coil and connected to the waveform shaper, the switching circuit being gated by a change in the level of the output signal of the waveform shaper;

a first timer connected to the waveform shaper for measuring a first length of time from a change in the output level of the waveform shaper;

means for generating a first reference voltage;

a first comparator responsive to the first timer for comparing the voltage across the resistor with the first reference voltage when the first length of time elapses and generating a corresponding output signal, the first reference voltage being less than the voltage across the resistor when the first length of time elapses if the secondary winding is connected to an open circuit;

a second timer connected to the waveform shaper for measuring a second length of time from a change in the output level of the waveform shaper, the second length of time being longer than the first length of time;

means for generating a second reference voltage which is smaller than the first reference voltage; and a second comparator responsive to the second timer for comparing the voltage across the resistor with the second reference voltage when the second length of time elapses and generating a corresponding output signal, the second reference voltage being less than the voltage across the resistor when the second length of time elapses if the secondary winding is shorted to ground.

12. An ignition apparatus for an internal combustion engine comprising:

an ignition signal generator which generates an ignition signal in synchrony with the rotation of an engine;

an ignition coil having a primary winding and a secondary winding;

a switching circuit connected to the ignition signal generator and the primary winding of the ignition coil for controlling the flow of current through the primary winding in accordance with the ignition signal;

a first timer for measuring a first length of time from the ignition signal; and a first comparator responsive to the first timer for comparing the winding voltage of one of the windings of the ignition coil with a first reference voltage when the first length of time elapses and generating a corresponding output signal, further comprising a resistor connected to the secondary winding, wherein the winding voltage is the voltage across the resistor.

* * * * *